United States Patent [19]

Maruyama et al.

[11] 4,415,308

[45] Nov. 15, 1983

[54] PUMP FOR SUPPLYING KEROSENE TO COMBUSTION APPARATUS

[75] Inventors: Teruo Maruyama, Neyagawa; Hiroo Ohshima, Nara; Fumio Iwai; Yoshikazu Abe, both of Neyagawa, all of Japan

[73] Assignee: Matsushita Electric Industrial Co., Ltd., Osaka, Japan

[21] Appl. No.: 252,595

[22] Filed: Apr. 9, 1981

[30] Foreign Application Priority Data

Apr. 15, 1980 [JP] Japan ..... 55-49708

[51] Int. Cl.[3] ..... F01D 5/00; F01D 11/00

[52] U.S. Cl. ..... 415/72; 415/169 A; 417/410

[58] Field of Search ..... 417/410; 415/71-74, 415/169 A, 170 B, 143, 90, 99

[56] References Cited

U.S. PATENT DOCUMENTS

| | | | |
|---|---|---|---|
| 268,606 | 12/1882 | Barbour et al. | 415/72 UX |
| 3,171,356 | 3/1965 | Pensabene | 417/410 X |
| 3,643,516 | 2/1972 | Jacobson | 415/90 X |
| 3,697,190 | 10/1972 | Haentjens | 415/73 |
| 3,870,433 | 3/1975 | Raikov et al. | 415/72 |

FOREIGN PATENT DOCUMENTS

| | | | |
|---|---|---|---|
| 2828345 | 1/1980 | Fed. Rep. of Germany | 415/143 |

*Primary Examiner*—Stephen Marcus
*Assistant Examiner*—Joseph M. Pitko
*Attorney, Agent, or Firm*—Joseph W. Farley

[57] ABSTRACT

A pump for supplying kerosene to a combustion apparatus having means for giving a drive force for producing relative rotation between a housing and a shaft, at least one shallow groove formed in one of the surface of the shaft and the surface of the housing movable relative to the shaft surface, and an inlet bore and an outlet bore for the kerosene to be forced forward by the groove. The pump is characterized in that the groove has a depth ho defined by $$0.00558q\mu < ho < 250\mu$$

wherein q is the heat output of the combustion apparatus in kcal/h.

8 Claims, 14 Drawing Figures

PUMP FOR SUPPLYING KEROSENE TO COMBUSTION APPARATUS

The present invention relates to a pump for supplying kerosene to combustion apparatus, such as a water heater, water boiler, fan heater, range, etc., and more particularly to a kerosene supplying pump which is useful for apparatus such as those mentioned above and which has the following features and functions.

(1) Being capable of controlling the fuel supply over a wide range to assure clean combustion.
(2) Involving reduced variations in pressure and flow rate to ensure stabilized combustion.
(3) Being capable of controlling an exceedingly small flow rate.
(4) Producing only small vibration and noise.
(5) Being simple in construction and available at a reduced cost.

For the saving of energy, there has been a growing demand for pumps which are adapted to give accurately controlled small flow rates to render combustion apparatus operable with an improved efficiency under optimum combustion control and thereby assure clean combustion. In the case of gasifying burners of the rotary type for which kerosene is used, the fuel is centrifugally atomized and then gasified in a vaporizing cylinder to form a gaseous mixture of fuel and air for combustion. With such burners, it is most critical to feed kerosene to the gasifying chamber of the combustion unit at a given rate and to atomize the kerosene to particles of the smallest possible size.

Compact space heaters presently available for household uses include those having incorporated therein such a burner, to which fuel is supplied by a free piston type electromagnetic pump resorting to pulse width modulation. The electromagnetic pump comprises a plunger which is provided between resilient springs acting in opposite directions and which is reciprocated by intermittent magnetic attraction produced by a solenoid coil to supply kerosene to the combustion chamber at a constant rate. The known electromagnetic pump is so adapted that power of modulated pulse width is applied to the solenoid coil to intermittently drive the plunger and thereby supply kerosene at a rate of about 5 to 7 cc/min.

However, with the wide use of space heaters of the vaporizing type, it has become strongly desired to give a variable heat output over a wider range than heretofore possible for more delicately controlled comfortable space heating or for savings of energy.

When giving a heat output which is variable from 3500 kcal/h to 1000 kcal/h, the supply of kerosene by the pump, which is presently variable from 5 to 7 cc/min, must be made variable over a wider range of from about 2 to 7 cc/min. Thus the minimum flow rate of the pump must be made lower than $\frac{1}{3}$ the maximum flow rate thereof. To give a still smaller heat output, the supply must be reduced further.

However, when, for example, obtaining a heat output of 3500 kcal/h by driving the plunger at a pulse frequency of 10 Hz, the pump output per stroke must be (7 cc/min/10)=(0.12 cc/sec/10)=0.012 cc, which is an exceedingly small amount to obtain with accuracy. Thus the variable range is limited to 5 cc/min to 7 cc/min.

Further gear pumps involve a lower limit of as much as 30 cc/min due to the leakage of kerosene through a gear-to-gear clearance.

While pumps with a screw-shaped grooved member are used for feeding viscous materials and for supplying lubricant to internal combustion engines, such pumps have large grooves for conveying the viscous fluid at a high rate and therefore cannot be technically compared with those intended for use with kerosene which has a very low viscosity.

The main object of the present invention is to overcome the problems encountered with conventional pumps and to provide a pump for supplying kerosene to combustion apparatus which is simple and compact in construction, inexpensive to manufacture and stable in pressure and flow rate characteristics, assures stabilized combustion and produces reduced noise during operation.

To fulfill this object, the present invention provides a pump for supplying kerosene to a combustion apparatus having means for giving a drive force for producing relative rotation between a housing and a shaft supported by the housing and rotatable relative thereto, at least one shallow groove formed in one of the surface of the shaft and the surface of the housing movable relative to the shaft surface, and an inlet bore and an outlet bore for the kerosene to be forced forward by the groove, the pump being characterized in that the groove has a depth ho defined by $$0.00558q\mu < ho < 250\mu$$

wherein q is the heat output of the combustion apparatus in kcal/h.

Various other features and advantages of the invention will become apparent from the following description of a preferred embodiment given with reference to the accompanying drawings, in which.

Figure 1:
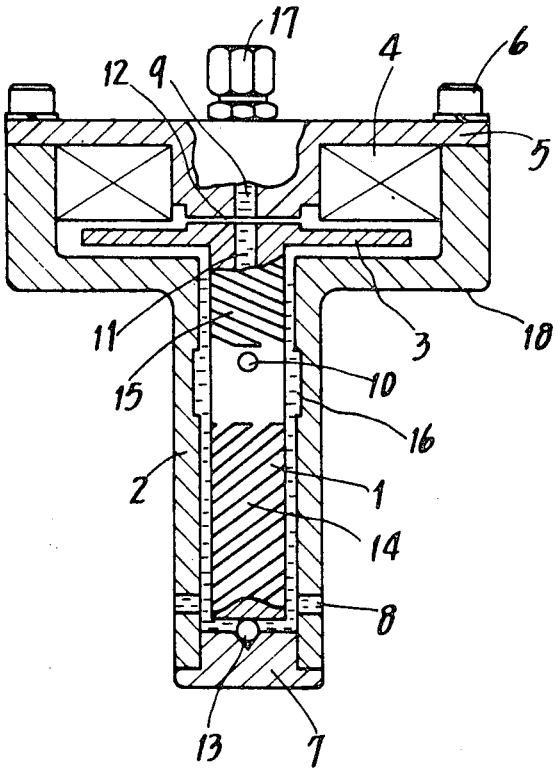
FIG. 1 is a view in vertical section showing a pump embodying the invention for supplying kerosene to combustion apparatus.

FIG. 1 shows a rotary member, namely a rotary shaft, 1, a stationary member, namely a housing, 2, a motor rotor 3 fixed to the rotary shaft 1, a stator 4, a case 5 accommodating the stator 4, bolts 6 for fastening the housing 2 to the case 5, and a lower cover 7 fixed to the lower end of the housing 2.

The housing 2 has at a lower portion thereof inlet bores 8 extending through its side wall. The case 5 has an outlet bore 9 extending centrally therethrough. The rotary shaft 1 has a port 10 extending from an outer peripheral portion thereof toward its axis. A channel 11 extending from the upper end of the rotary shaft 1 downward coaxially therewith is in communication with the port 10. Spiral grooves 12 are formed in the upper end of the rotary shaft 1 to provide a thrust fluid bearing. A ball 13 provided between the lower end of the rotary shaft 1 and the lower cover 7 serves as a pivot bearing.

Figure 2:
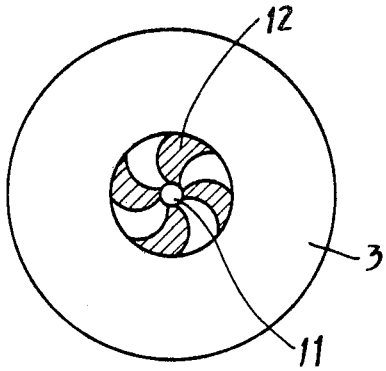
FIG. 2 is a top view showing the rotor of a motor.

As shown in FIG. 2, the spiral grooves 12 are formed in the top surface of the rotor 3 around the opening of the channel 11 symmetrically with respect to its center. Thus the grooves 12 and the intervening ridges are formed alternately circumferentially of the rotor. In FIG. 2, the grooves are hatched.

The rotary shaft 1 has pumping helical grooves 14 in its outer periphery between the lower end thereof and the port 10. Sealing helical grooves 15 are also formed in the outer periphery of the rotary shaft between the port 10 and the rotor 3. In the vicinity of the port 10 of the rotary shaft 1, the housing 2 has a large inner diameter portion 16. Indicated at 17 is a pipe joint for supplying kerosene, and at 18 the surface to be attached to a kerosene tank or the like for the installation of the pump.

The parts 1 and 3 provide the rotary assembly of the present pump, while the parts 2, 4, 5 and 7 provide the stationary assembly of the pump.

Further the stator 4 (primary element, coil) and the rotor 3 (secondary element, conductor) are arranged face-to-face to constitute a rotation induction motor.

The rotary magnetic field set up by the primary coil generates an eddy current on the surface of the secondary conductor (rotor 3), and the product of the magnetic field and the eddy current through the secondary conductor (rotor 3) produces continuous thrust (torque) based on Fleming's rule of left hand. While electromagnetic induction further produces an axial vertical force between the rotor 3 in rotation and the stator 4, this vertical force and the fluid pressure produced by the spiral grooves 12 of the rotor 3 come into balance with a vertical counteracting force from the pivot bearing 13, whereby the movable assembly is restrained axially.

Figure 3:
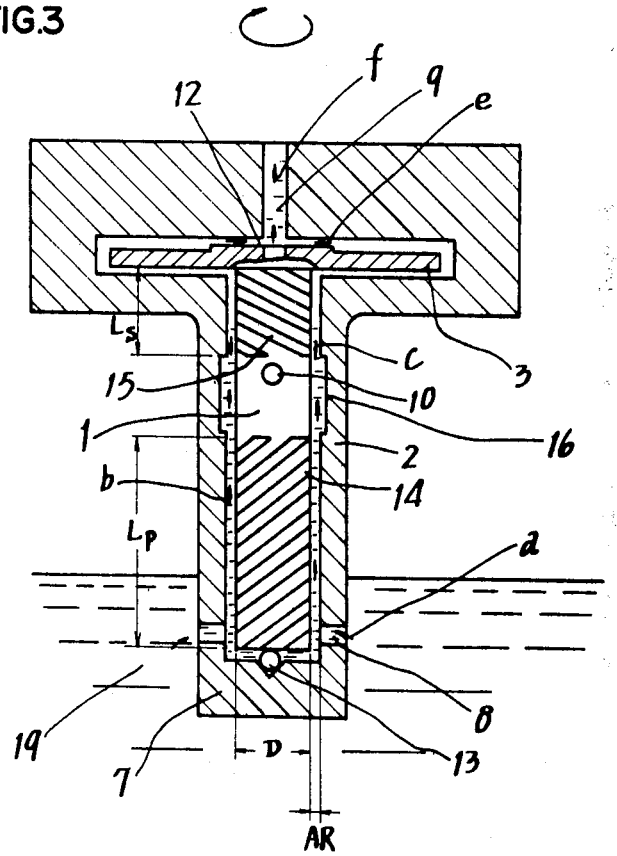
FIG. 3 is a view in vertical section of the pump showing the flow of kerosene.

FIG. 3 shows the flow of kerosene when the pump is driven with its lower end held immersed in a kerosene tank. When the rotary shaft 1 and the housing 2 rotate relative to each other, the pumping helical grooves 14 force up a portion of kerosene 19 through the grooves as indicated by an arrow b, drawing into the pump another portion of kerosene 19 from the tank through the inlet bores 8 as indicated by an arrow a. The kerosene 19 therefore rises continuously as indicated by the arrow b. When reaching the level of the port 10, the kerosene 19 is forced backward as indicated by an arrow c by the sealing helical grooves 15 which act in the direction opposite to the direction of action of the pumping helical grooves 14. Consequently the kerosene 19 flows solely into the port 10.

Subsequently the kerosene passes through the channel 11 along the axis of the rotary shaft 1 and flows out from the opening at the upper end of the shaft 1, where the kerosene 19 is prevented from flowing radially by the spiral grooves 12 which act to force the fluid in the direction of an arrow e at the upper end of the shaft 1.

Accordingly the kerosene 19 flows only into the outlet bore 9 formed in the center of the case 5, passes through a pipe (not shown) connected to the pump and is fed to a combustion chamber as indicated by an arrow f.

Figure 5:
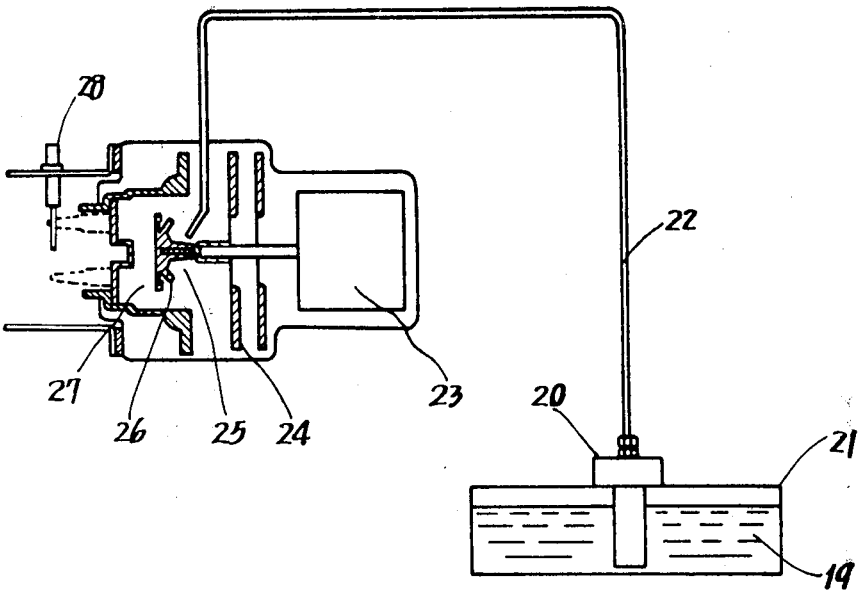
FIG. 5 is a diagram showing a rotary gasifying burner and the pump of FIG. 1 as used therefor.

FIG. 5 schematically show a rotary gasifying burner and the present pump as used for the burner. A kerosene tank 21 is provided at an upper portion thereof with the pump 20 shown in FIGS. 1 to 3. Indicated at 22 is a pipe for supplying kerosene 19 to a combustion chamber, at 23 a motor for the burner, at 24 a turbofan, at 25 a rotor, at 26 an agitator plate, at 27 a vaporizing chamber, and at 28 a flame rod.

In FIG. 5 the conical rotor 25 is driven by the burner motor 23 to feed the kerosene dropwise from the pipe 22 at a constant rate.

The kerosene 19 supplied dropwise is centrifugally spread over the tapered surface of the rotor 25, further forced outward radially thereof and reduced to minute particles by the agitator plate 26. The kerosene in the form of minute particles is gasified within a vaporizing chamber 27 heated by an unillustrated heater.

Since the pump of this invention is intended to forcibly feed kerosene which has a very low viscosity, the helical or spiral grooves of the pump can be of much smaller depth than the grooves of conventional grooved pumps which are made by machining in larger dimensions. Thus one of the features of the pump of this invention is that the groove pattern can be formed advantageously by a chemical working process, such as etching or plating.

The present pump differs greatly from conventional grooved pumps in the following characteristics.

(1) The pump feeds kerosene at an exceedingly small flow rate.

(2) It is less affected by variations in load.

The pump described above supplies kerosene at a very small rate Q of more than 0.1 cc/min but less than 25 cc/min, because household combustion apparatus for use with kerosene generally have the following heat outputs.

TABLE 1

| Apparatus | Heat output (kcal/h) |
|---|---|
| Space heater | 2,000–10,000 |
| Fan-forced heater | 1,000–3,000 |
| Range | 500–2,000 |
| Portable range | Up to 1,000 |

Combustion apparatus for use with kerosene must have constant flow rate characteristics because the operating point of the pump shifts to result in variations in the flow rate, i.e. in the state of combustion, due to the influence of the back pressure of the burner in the combustion chamber or to variations in the viscosity of kerosene caused by changes in temperature. It is desired that the pump have characteristics less susceptible to the influence of load variations.

Figure 4:
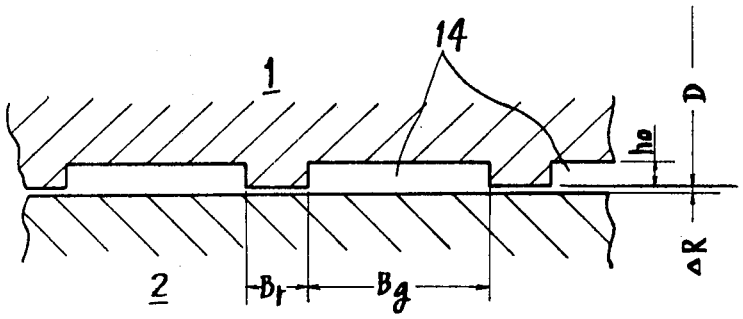
FIG. 4 is a sectional view showing a helical groove in detail.

Table 2 below shows the characteristics of the pump determined by varying dimensions of the pump and the shape and dimensions of the helical grooves 14 (see FIGS. 3 and 4).

TABLE 2

| Parameter | | Variations in characteristics* Max. flow rate $Q_{max}$ | Max. pressure $P_{max}$ |
|---|---|---|---|
| Clearance | ΔR | Almost unchanged | Small |
| Axial length of pumping grooved portion | $L_P$ | Almost unchanged | Large |
| Diameter of shaft | D | Large | Large |
| Speed of rotation | N | Large | Large |
| Groove/ridge ratio** | Bg/Br | Large | Almost unchanged |
| Depth of grooves | ho<hm | Large | Large |
| Depth of grooves | ho>hm | Large | Small |
| Groove angle*** | $0° < a_p < 7°$ | Large | Large |
| Groove angle*** | $7° < a_p < 45°$ | Large | Small |
| Groove angle*** | $45° < a_p < 90°$ | Small | Small |

Note
*When the parameter concerned is large.
**Ratio of groove width to ridge width.
***The angle of inclination of the helical grooves (the same as in the following tables).

The maximum flow rate $Q_{max}$ is the rate when the outlet pressure of the pump P is zero. The maximum pressure $P_{max}$ is the pressure when the flow rate Q is zero with the outlet of the pump closed.

When $Q_{max}$ is higher, the flow rate is available with a greater latitude. The higher the pressure $P_{max}$, the less susceptible are the characteristics to the influence of load variations.

In the case of combustion apparatus for use with kerosene, the pressure $P_{max}$ should not lower than 0.2 kg/cm$^2$ in view of the fact that the pump is used at an operating point $P_N$ which is less than $P_{max}$.

The parameters will be described below in detail.

Figure 6:
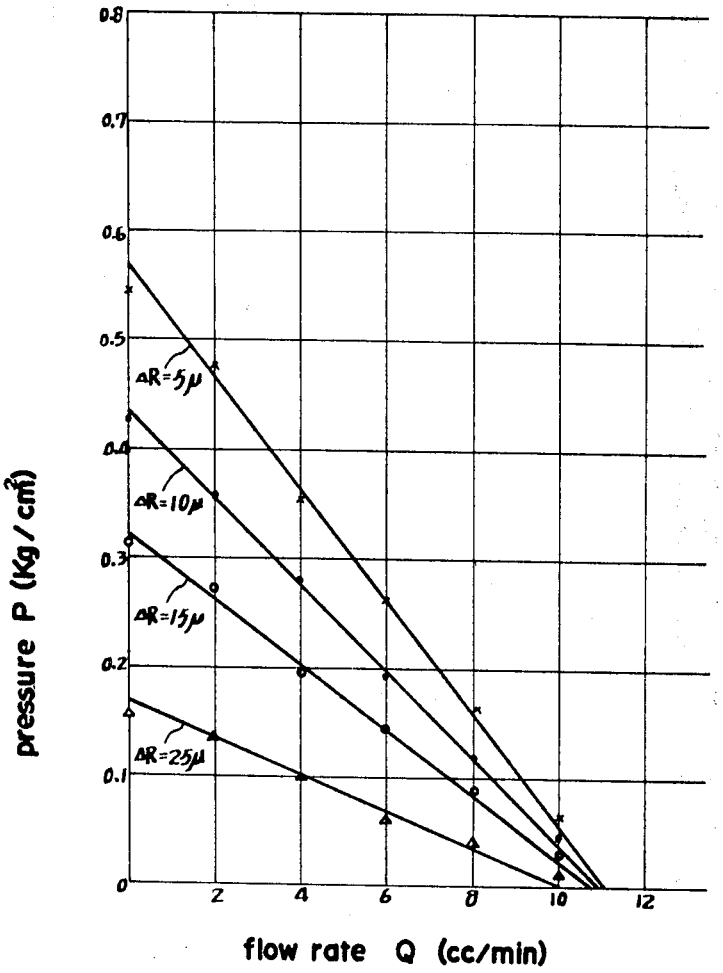
FIG. 6 is a diagram showing the pressure-flow rate characteristics of the pump wherein a clearance $\Delta R$ is used as a parameter.

FIG. 6 shows the pressure-flow rate characteristics of the pump determined under the conditions of Table 3, using the clearance ΔR as a parameter.

TABLE 3

| Parameter | Symbol | Value |
|---|---|---|
| Outside diameter of shaft | D | 0.8 cm |
| Axial length of pumping grooved portion | $L_p$ | 3.0 cm |
| Groove angle | $d_p$ | 30° |
| Width of grooves | Bg | 0.3 cm |
| Width of ridges | Br | 0.1 cm |
| Depth of grooves | ho | 60μ |
| Speed of rotation | N | 1800 r.p.m. |

Since kerosene has a very low viscosity, the fuel leaks in a large amount from a high-pressure portion to a low-pressure portion in the interior of the present pump. Accordingly it has been found that the clearance ΔR also influences very greatly the pump characteristics. Usually JIS No. 1 kerosene is used for combustion apparatus for household uses. In the range of temperatures (−20° to 50° C.) at which household combustion apparatus are used, the kerosene has a viscosity $\eta$ of 0.85 to 2 cst.

As the clearance ΔR decreases, the leakage decreases and the maximum pressure $P_{max}$ increases but the maximum flow rate $Q_{max}$ remains almost unchanged. Thus the smaller the clearance ΔR, the better is the result achieved, but there is a limitation in ensuring a uniform small clearance ΔR accurately for quantities of product, so that the clearance is limited to about 10μ if smallest.

The axial length Lp of the pumping grooved portion produces little or no influence on the maximum flow rate $Q_{max}$ of the pump, while if the Lp is larger, the leak through the fluid channel can be prevented more effectively proportionally, so that the maximum pressure increases almost proportionally. However, the Lp is limited because the overall length L of the rotary shaft 1 to be incorporated into the product is limited. The actual length L of the rotary shaft 1 is the Lp plus the length Ls of the sealing grooved portion. The entire length of the pump is the length L plus the axial dimension of the motor assembly (FIG. 3).

With an increase in the diameter of the shaft, D, both $P_{max}$ and $Q_{max}$ increase nearly in proportion thereto, but the weight and dimensions of the product, the torque for driving the motor (especially for start-up), etc. impose limitations on the shaft diameter. It is preferred that the overall length L and diameter D of the shaft 1 be in the range of $D \times L = 10$ cm$^2$ if largest.

The pump is available most inexpensively when the motor is of the a.c. induction type. When a fourpole induction motor, which is commercially advantageous, is used as a power frequency f of 60 Hz, the speed of rotation, N, obtained is $(120/4) \times 60 = 1800$ r.p.m. in which 4 is the number of the poles. Further in view of the performance of the pump, there are limitations on the speed of rotation for the prevention of the following troubles.

(1) Deflective rotation due to unbalance.
(2) Wear and seizure of sliding parts.

The degree of deflective rotation (1) due to unbalance increases in proportion to the second power of the speed of rotation. The troubles (2) are likely to occur when the pump is initiated into rotation without allowing kerosene to fully penetrate into the pump, for example, after the pump has been left out of use for a long period of time. While the pump has not been sufficiently lubricated with kerosene, the higher the speed of rotation, the greater is the likelihood that sliding parts will seize. In practice, therefore, it is preferable to limit the speed of rotation, N, to about 1800–2000 r.p.m.

Figure 7:
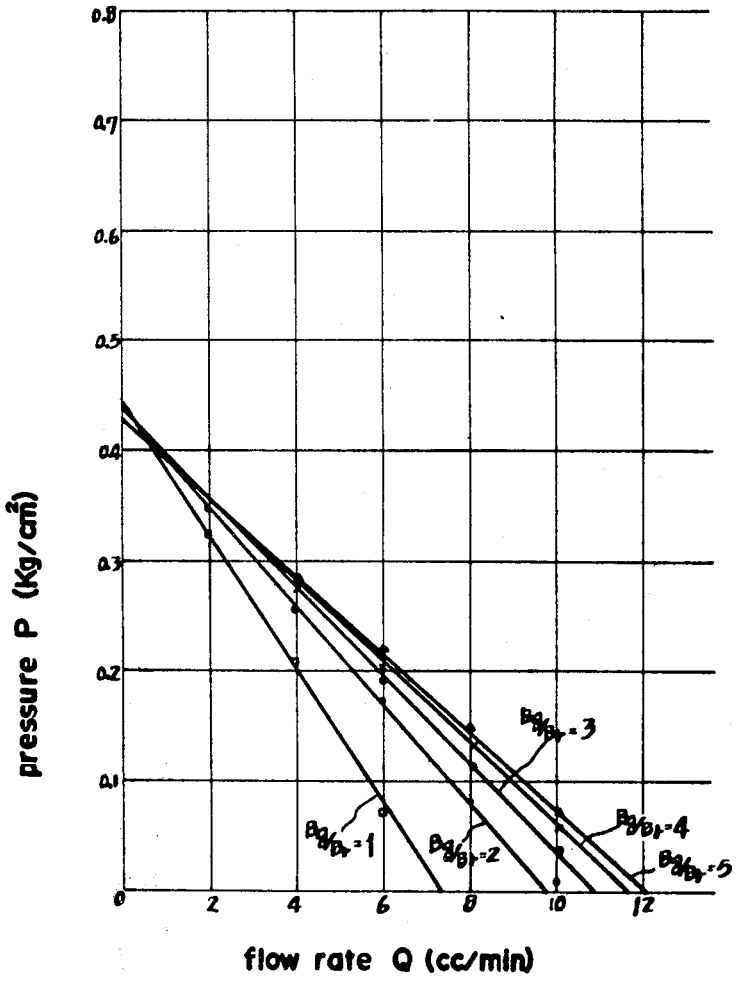
FIG. 7 is a diagram showing pressure-flow rate characteristics determined with use of the ratio of groove width to ridge width, Bg/Br, as a parameter.

FIG. 7 shows the pressure-flow rate characteristics of the pump determined under the same conditions as listed in Table 3 except that the clearance ΔR is 10μ and that the Bg/Br ratio is used as a parameter.

When the ratio of the groove width to the ridge width, namely Bg/Br, is increased, the maximum flow rate $Q_{max}$ increases as seen in FIG. 7 while the maximum pressure $P_{max}$ remains almost unchanged. The $Q_{max}$ increases greatly when the ratio Bg/Br is between 1 to 2, but only slightly when the Bg/Br ratio is 4 to 5.

The groove depth ho has a value hm which gives a maximum for the maximum pressure $P_{max}$. When the ho is smaller or larger than hm, the $P_{max}$ is lower. On the other hand, the maximum flow rate $Q_{max}$ is in proportion to ho (see FIGS. 10 and 11 to be described later).

Figure 9:
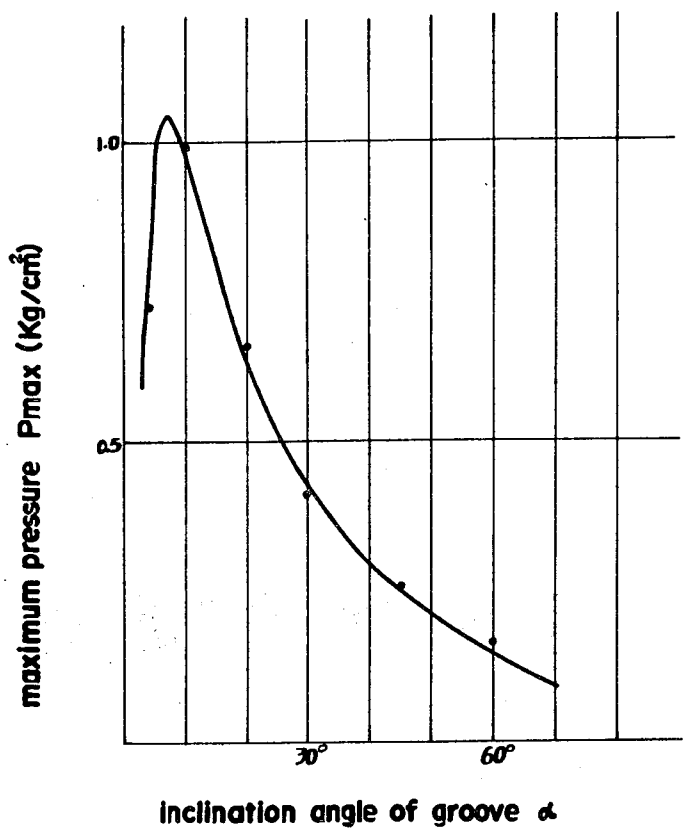
FIG. 9 is a diagram showing maximum pressure characteristics relative to the groove angle.
Figure 8:
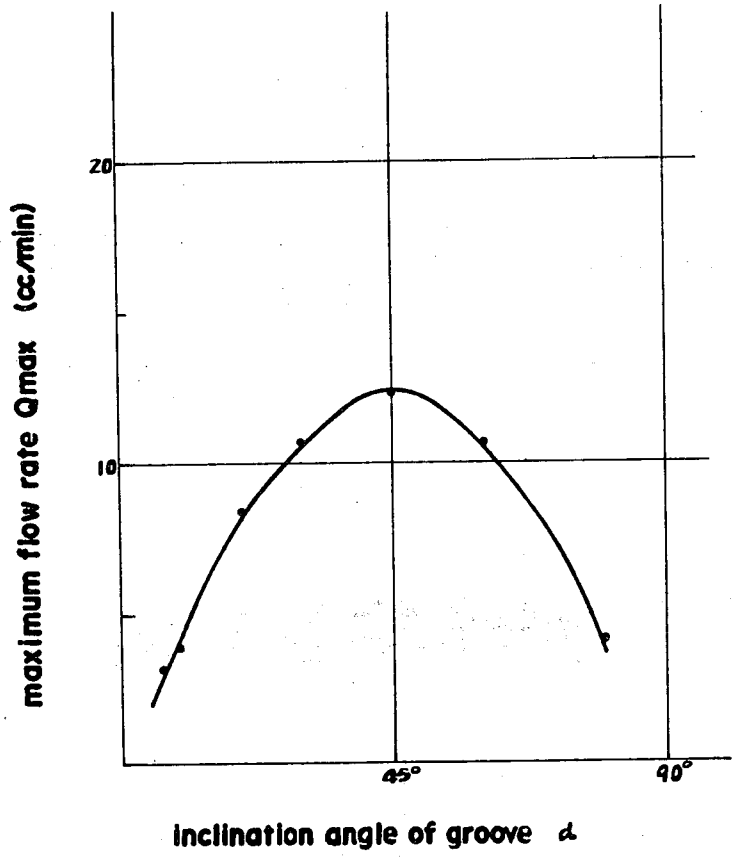
FIG. 8 is a diagram showing maximum flow rate characteristics relative to groove angle.

When the angle of inclination $\alpha_p$ with respect to a phantom plane at right angles to the axis is in the range of $7° < \alpha_p < 45°$, the $P_{max}$ is in a reverse relation to the $Q_{max}$. More specifically stated, when $\alpha_p$ is close to about 45°, the flow rate is largest as seen in FIG. 8, whereas when the angle $\alpha_p$ is approximate to 7°, the pressure is highest as seen in FIG. 9. Accordingly a suitable angle $\alpha_p$ can be determined in the range of $7° \leqq \alpha_p \leqq 45°$ in view of the maximum pressure (shut-off pressure) $P_{max}$ and the maximum flow rate $Q_{max}$ relative to each other.

The results discussed above indicate that the greatly conflicting relation between the maximum flow rate $Q_{max}$ and the maximum pressure $P_{max}$ that would be involved in practice is dependent on the groove depth ho and the angle of inclination (groove angle) $\alpha_p$ among other parameters listed in Table 2. While the angle $\alpha_p$ has been described above, the groove depth ho will now be described in detail.

Figure 10:
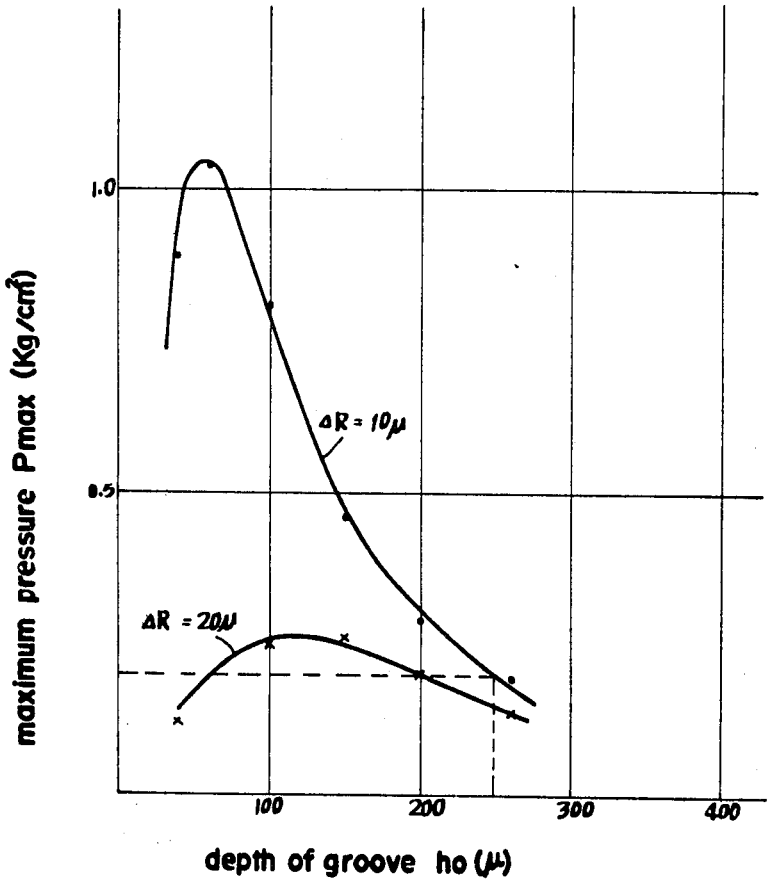
FIG. 10 is a diagram showing maximum pressure characteristics relative to groove depth.

FIG. 10 shows the maximum pressure characteristics of the pump as determined under high-temperature conditions (viscosity of kerosene $\eta=0.85$ cst at 50° C.) when the pump has the parameters given in Table 4 below and varying groove depths ho.

TABLE 4

| Parameter | Symbol | Value |
|---|---|---|
| Outside diameter of shaft | D | 1.0 cm |
| Axial length of pumping grooved portion | $L_p$ | 4.0 cm |
| Groove angle | $\alpha_p$ | 7° |
| Width of grooves | Bg | 0.322 cm |
| Width of ridges | Br | 0.064 cm |
| Clearance | ΔR | 10μ |
| Speed of rotation | N | 1800 r.p.m. |

The shut-off pressure $P_{max}$ available with the pump having the parameters of Table 4 is the upper limit value for the pump when the pump is subject to the condition that it can be manufactured in large quantities.

While the rotary shaft 1 of this embodiment has a length L of 10 cm, the pumping helical grooves 14 are formed over a length Lp of 4 cm for the following reason.

The sealing helical grooves 15 formed above the pumping helical grooves 14 as shown in FIG. 1 are designed to prevent ingress of kerosene into the shaft drive assembly. The sealing grooves must be so formed as to give a sufficient seal pressure in preparation for an emergency. For example, when dust or the like in the kerosene blocks the fluid channel from the pump to the combustion chamber, a maximum pressure (shut-off pressure $P_{max}$) will build up at the outlet side. To prevent leakage of the fuel from the pump even in such an event, the seal pressure must be greater than the shut-off pressure $P_{max}$. When the leak-free safety ratio for the present pump is $\mu$, the length of the sealing grooved portion, Ls, must be $\mu$ times larger than the length of the pumping grooves portion, Lp. When $\mu$ is 1.5, Lp is 4.0 cm and Ls is 6.0 cm.

When the pump is to be fabricated actually, the angle of inclination $\alpha_p$ of the pumping helical grooves 14 can be as large as, for example, 30° to 45°. Thus the sealing grooved portion, when having an angle of inclination $\alpha_s$ which is smaller than $\alpha_p$, can be shorter. Consequently the length Lp of the pumping grooved portion can be made longer. However, if the $\alpha_p$ is larger, the shut-off pressure $P_{max}$ is smaller, and the increment of pressure resulting from the increase of the groove length is not as great as when the $\alpha_p$ is decreased. Thus the shut-off pressure $P_{max}$ of the pump with the parameters of Table 4 is the upper limit value.

FIG. 10 showing the upper limit value for $P_{max}$ reveals that the groove depth ho must not exceed 250μ in order to obtain a shut-off pressure $P_{max}$ of 0.2 kg/cm$^2$.

Figure 11:
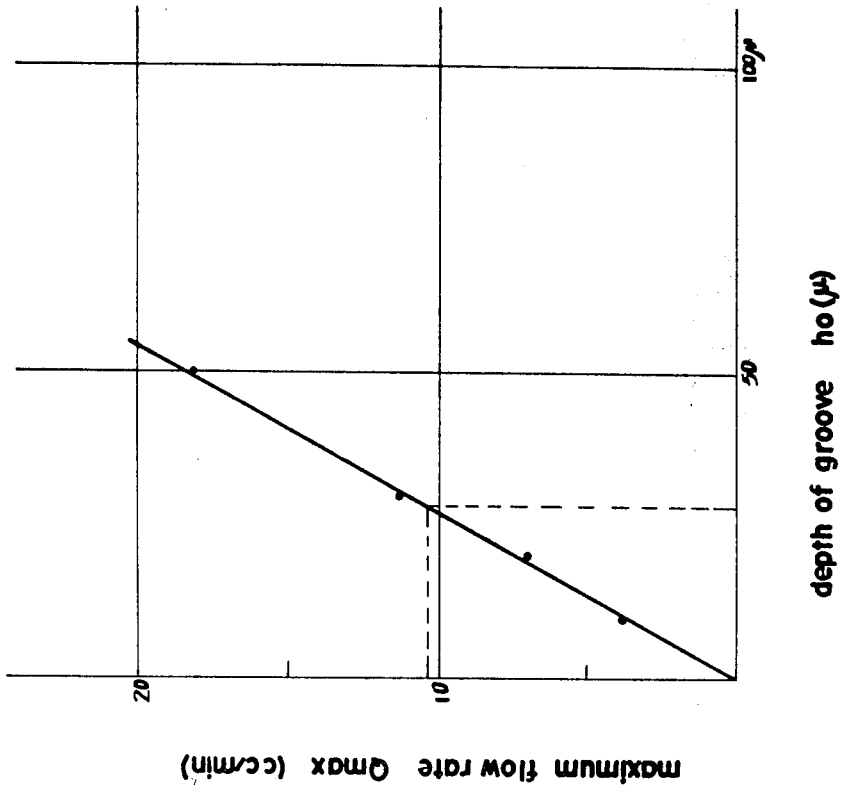
FIG. 11 is a diagram showing maximum flow rate characteristics relative to groove depth.

FIG. 11 shows the maximum flow rate characteristics of the pump when the pump has the parameters of Table 5 below and varying groove depths ho.

TABLE 5

| Parameter | Symbol | Value |
|---|---|---|
| Outside diameter of shaft | D | 1.0 cm |
| Axial length of pumping grooved portion | $L_p$ | 7.5 cm |
| Groove angle | $\alpha_p$ | 45° |
| Width of grooves | Bg | 0.437 cm |
| Width of ridges | Br | 0.087 cm |
| Speed of rotation | N | 1800 r.p.m. |

FIG. 11 shows the lower limit for the groove depth ho required for a flow rate at which kerosene is to be supplied, subject to the condition that the pump can be manufactured by mass production. The required kerosene flow rate is dependent on the heat output of the combustion apparatus. The flow rate needed for giving a heat output of q kcal/h is Q cc/min which is 0.00205q. For example, the flow rate Q needed for a heat output q of 5,000 kcal/h is 10.3 cc/min. FIG. 11 shows that the groove depth ho must be at least 28μ to assure this flow rate.

This value is the maximum flow rate $Q_{max}$ when P=0. In view of the fact that the operating point of the pump used is larger than 0, the groove depth ho should be larger than the above value. With reference to FIG. 11, the $Q_{max}$ characteristics curve relative to ho can be given generally by the following equation.

$$ho=2.72Q=0.00558q$$

Accordingly in view of the above and also the upper limit value for the groove depth already described, the groove depth of the present pump for supplying kerosene to combustion apparatus has the limits defined by:

$$0.00558q\mu<ho<250\mu$$

Given below are the features of the present pump in which the shallow groove pattern of the helical grooves 14 are used for pumping kerosene.

(1) The mode of combustion is controllable continuously.

Figure 12:
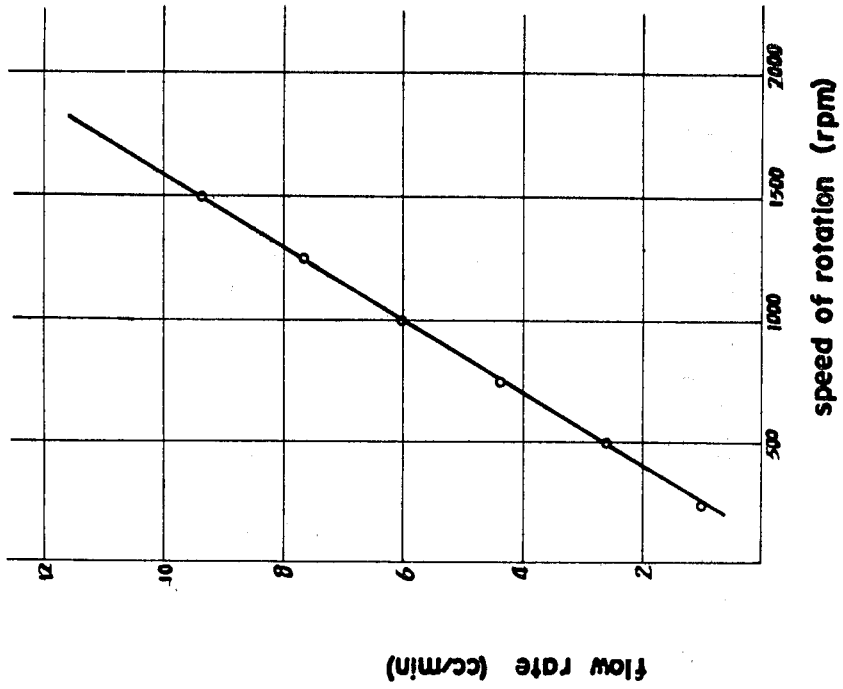
FIG. 12 is a diagram showing flow rate characteristics relative to speed of rotation.

FIG. 12 shows the flow rate characteristics of the pump at varying speeds of rotation when the pumping helical grooves 14 of the pump having the following parameters.

TABLE 6

| Parameter | Symbol | Value |
|---|---|---|
| Outside diameter of shaft | D | 0.8 cm |
| Axial length of pumping grooved portion | $L_p$ | 5.0 cm |
| Groove angle | $\alpha_p$ | 45° |
| Width of grooves | Bg | 0.377 cm |
| Width of ridges | Br | 0.126 cm |
| Clearance | ΔR | 20μ |
| Depth of grooves | ho | 60μ |

FIG. 12 reveals that the flow rate is proportional to the speed of rotation even when the flow rate is below 5 cc/min which is the lower limit for conventional plunger pumps.

It is also seen that the flow rate varies linearly with the speed of rotation, indicating that the mode of combustion is continuously controllable by varying the speed of rotation over a wider range.

(2) The pump involves greatly reduced variations in pressure and flow.

Figures 13A, 13B:
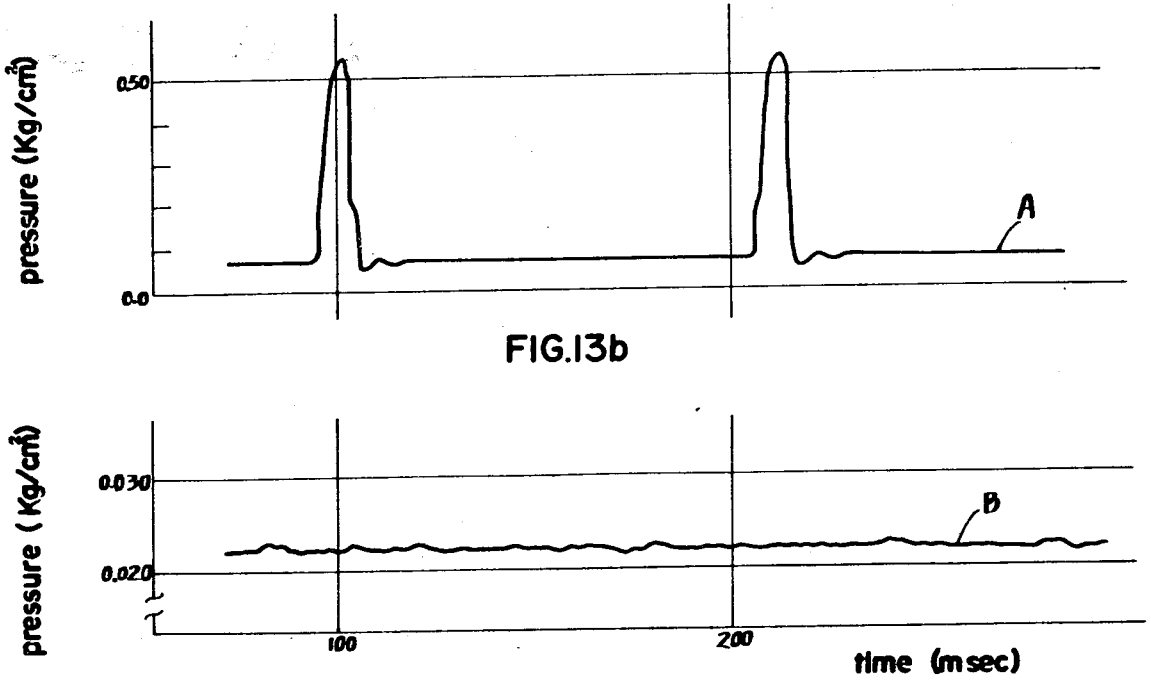
FIGS. 13*a* and 13*b* are diagrams showing the pressure variation characteristics of a conventional plunger pump and the pump of FIG. 1, respectively.

FIGS. 13*a* and 13*b* show the pressure variation characteristics of a conventional plunger pump and the pump of the invention for comparison. The characteristics A of the conventional pump involve great pressure variations attributable to the modulated frequency (f=9 Hz), whereas the characteristics of the present pump, indicated at B, involve very slight variations. These characteristics are determined when the load resistance at the outlet side is 0.

The pressure variation ΔP of the plunger pump is about 0.5 kg/cm$^2$, whereas that of the present pump detectable is about 0.01 kg/cm$^2$, which is 1/50 the former value. Accordingly the present pump does not require the use of a tank for eliminating flow variations, U-shaped tube leveller or the like employed for conventional plunger pumps but can be connected directly to the combustion chamber for the supply of kerosene.

The pump of this invention having the outstanding characteristics described above is exceedingly simpler in construction and can be built with a much smaller number of parts at a lower cost than the conventional plunger pumps.

Although the rotary shaft 1 of the foregoing embodiments is grooved as at 14 and 15 and is rotatable, the housing 2 may alternatively be grooved similarly on its inner surface.

The rotary shaft 1 may be made stationary, and the housing 2 rotatable.

Although the induction motor shown in FIG. 1 comprises a rotor and a stator which are arranged face-to-face as axially opposted to each other, such components may be opposed to each other radially in a double tube arrangement.

The rotary shaft 1 may have a tapered shape and be accommodated in a tapered housing, in which case the shaft diameter D is the average diameter of the tapered shaft.

The pump need not always be uniform throughout the entire construction in respect of the groove depth, shaft diameter, groove angle, groove/ridge ratio, etc. The averages values for these values may be considered in the application of the foregoing disclosure.

The outlet bore 9 may be provided in the housing 2 of FIG. 1 in the vicinity of the upper end of the pumping grooved portion.

The present invention has the following advantages.

(1) The mode of combustion is controllable over a wider range to assure efficient and clean combustion.

(2) The pump involves only greatly reduced pressure and flow variations to assure stabilized combustion.

(3) Kerosene can be supplied at an exceedingly small rate to sustain a slow fire which is infeasiable with plunger pumps.

(4) Vibration or noise, if produced, is very slight.

(5) The pump is simple in construction, is therefore less costly to make and less susceptible to malfunctions.

What is claimed is:

1. A pump for supplying kerosene to a combustion apparatus comprising:

housing means provided therein with a passage and having an inlet and outlet, rotor means entirely accomodated within said housing means and including a shaft disposed in said passage of said housing means, said shaft and said passage having radially opposed surfaces, stator means carried by said housing means for electromagnetically rotating said rotor means relative to said housing means, pumping groove means formed in one of said radially opposed surfaces of said shaft and said passage for forcing the kerosene along said groove means by the rotation of said shaft and for forming a fluid bearing between the shaft surface and the passage surface by the kerosene, said pumping groove means comprising a helical groove formed in said surface of said shaft on a first axial portion of said shaft at one end thereof, said rotor means is provided at the other end of said shaft, and a sealing helical groove is formed on a second axial portion of said shaft adjacent to said rotor means, said sealing helical groove being inclined in a direction opposite to the inclination of said pumping helical groove, an axial channel provided in said shaft and communicating with said outlet of said housing means, and a port provided in said shaft intermediate said first and second axial portions thereof and extending between said channel and said surface of said shaft, said port being adapted to conduct kerosene from said pumping groove means to said axial channel, wherein said pumping groove means has a groove depth ho defined by $$0.00558q\mu < ho < 250\mu$$

where q is the heat output of the combustion apparatus in kcal/h.

2. A pump as defined in claim 1 wherein said opposed surfaces of said shaft and passage are cylindrical, and said pumping helical groove has an angle of inclination of 7 to 45 degrees with respect to a phantom plane at right angles to the axis of rotation of said shaft.

3. A pump as defined in claim 2 wherein the angle of inclination of said sealing helical groove is smaller than the angle of inclination of said pumping helical groove.

4. A pump as defined in claim 2 wherein there is a clearance of 10 to 25μ between said shaft surface and said passage surface.

5. A pump as defined in claim 4 wherein said axial channel is positioned at said other end of said shaft.

6. A pump as defined in claim 5 wherein said rotor means comprises a disc.

7. A pump as defined in claim 6 wherein said disc is provided with spiral grooves extending radially from said channel in axially opposed relation to said stator means for opposing the electromagnetic axial force between said stator means and said rotor means.

8. A pump as defined in claim 1 wherein said rotor means is provided with spiral groove means extending radially from said channel in axially opposed relation to said stator means for opposing the electromagnetic axial force between said stator means and said rotor means.

* * * * *